US007261641B2

(12) United States Patent
Lindner

(10) Patent No.: US 7,261,641 B2
(45) Date of Patent: Aug. 28, 2007

(54) METHOD AND APPARATUS FOR IMPROVING DYNAMIC RESPONSE OF GOLF CLUB

(75) Inventor: Jeffrey L. Lindner, Madison, AL (US)

(73) Assignee: Balance-Certified Golf, Inc., Madison, AL (US)

( * ) Notice: Subject to any disclaimer, the term of this patent is extended or adjusted under 35 U.S.C. 154(b) by 0 days.

(21) Appl. No.: 10/752,126

(22) Filed: Jan. 6, 2004

(65) Prior Publication Data

US 2004/0224787 A1 Nov. 11, 2004

Related U.S. Application Data

(63) Continuation-in-part of application No. 10/066,880, filed on Feb. 4, 2002, now abandoned.

(60) Provisional application No. 60/441,152, filed on Jan. 21, 2003, provisional application No. 60/441,119, filed on Jan. 21, 2003.

(51) Int. Cl.
*A63B 53/10* (2006.01)
*A63B 53/12* (2006.01)

(52) U.S. Cl. ..... 473/297; 473/299; 403/370

(58) Field of Classification Search ..... 473/296–299, 473/295, 293–294, 288, 307; 403/350–352, 403/314, 367–370, 301, 373; 29/263; 411/80
See application file for complete search history.

(56) References Cited

U.S. PATENT DOCUMENTS

| | | | | |
|---|---|---|---|---|
| 1,658,447 | A | 2/1928 | Lantz | |
| 1,696,462 | A | 12/1928 | Victor | |
| 1,704,544 | A * | 3/1929 | Novak | 473/299 |
| 2,051,083 | A * | 8/1936 | Hart | 473/297 |
| 2,280,662 | A * | 4/1942 | Pawsat | 403/370 |
| 3,539,185 | A * | 11/1970 | Andis | 473/296 |
| 4,058,312 | A | 11/1977 | Stuff et al. | |
| 4,461,479 | A | 7/1984 | Mitchell | |
| 4,600,195 | A | 7/1986 | Hunter | |
| 4,674,746 | A | 6/1987 | Benoit | |
| 4,690,407 | A | 9/1987 | Reisner | |
| 4,869,511 | A | 9/1989 | Spoonster, Sr. | |

(Continued)

FOREIGN PATENT DOCUMENTS

| | | |
|---|---|---|
| EP | 92306514.8 | 3/1993 |

(Continued)

*Primary Examiner*—Stephen Blau
(74) *Attorney, Agent, or Firm*—Paul Sykes; Bradley, Arant, Rose & White

(57) ABSTRACT

An apparatus for improving the dynamic response of a golf club by selectively weighting the grip end of the club. One embodiment comprises a cylindrical member having a lower base portion and an upper housing portion. The base is sized to be inserted into the grip end of a golf club shaft with the upper housing extending wholly or partially from the end of the shaft. The housing has a hollow, open chamber in which a weighted insert is inserted and removably secured. Another embodiment comprises upper and lower complimentary cylindrical wedges, each with a bore along its longitudinal axis, sized to be inserted into the grip end of a golf club shaft and secured by a screw extending through the longitudinal bores and threaded into a threaded insert located in a cavity in the lower wedge.

7 Claims, 12 Drawing Sheets

U.S. PATENT DOCUMENTS

| | | | | |
|---|---|---|---|---|
| 4,887,815 | A | | 12/1989 | Hughes et al. |
| 4,936,586 | A | * | 6/1990 | Van Raemdonck ..... 473/519 |
| 4,988,102 | A | | 1/1991 | Reisner |
| 5,277,059 | A | | 1/1994 | Chastonay |
| 5,364,102 | A | | 11/1994 | Appledorn |
| 5,390,921 | A | | 2/1995 | De Ruyter |
| 5,465,967 | A | | 11/1995 | Boeckenhaupt |
| 5,716,289 | A | * | 2/1998 | Okoneski ..... 473/297 |
| 5,722,899 | A | | 3/1998 | Cheng |
| 5,746,664 | A | | 5/1998 | Reynolds, Jr. |
| 5,766,088 | A | | 6/1998 | Severtsen |
| 5,871,140 | A | | 2/1999 | McCrink |
| 6,007,431 | A | | 12/1999 | Bloom, Jr. |
| 6,190,267 | B1 | | 2/2001 | Marlowe et al. |
| 6,364,787 | B1 | | 4/2002 | Huiskamp |

FOREIGN PATENT DOCUMENTS

| | | |
|---|---|---|
| EP | 92310738.7 | 6/1993 |
| EP | 0377673 B1 | 5/1997 |
| EP | 01304012.6 | 11/2001 |
| GB | 11118 | 7/1901 |

* cited by examiner

METHOD AND APPARATUS FOR IMPROVING DYNAMIC RESPONSE OF GOLF CLUB

This application is a continuation-in-part of and claims the benefit of U.S. patent application Ser. No. 10/066,880, filed Feb. 4, 2002 now abandoned; claims the benefit of U.S. provisional patent application No. 60/441,152, filed Jan. 21, 2003; and claims the benefit of U.S. provisional patent application No. 60/441,119, filed Jan. 21, 2003.

BACKGROUND

The present invention provides a method and apparatus for improving the dynamic response or feel of a golf club as it strikes a golf ball during play. The golf swing can be divided into six major components: initial alignment coupled with alignment stability; the back swing; the forward swing; ball impact; dynamic response of the club; swing follow through. These swing components are applicable both to full swing clubs and putters.

Although there are many products and prior patents relating to adjusting the swing weight, feel, or balance of a golf club, few if any of these devices are directed towards improving the dynamic response, or feedback, of the club to the golfer at ball impact. Most prior art devices are aimed more specifically at the static or quasi-static feel of the club in the golfer's hand at the initial alignment, or during the back and forward swings. Such devices usually focus on the feel of the club itself, not the feel of the shot through the club. The importance of impact and dynamic response to the golfer's game are often overlooked.

Impact is momentary, but it is at and immediately following this critical moment that the golfer feels his shot through the dynamic response of the club. As many golfers will confess, after impact one often knows where the ball is heading without having to actually see its trajectory. The golfer has only one tactile interface to the club, and that is through his hands which grasp the club's shaft on the grip. It is thus through the golfer's hands gripping the shaft that the dynamic response of the club to the golfer's stroke is communicated. This dynamic response is a result of the vibration characteristics of the club, and the golfer often perceives it simply as feel. Thus it follows that if the club's dynamic response can be increased in this specific gripping area, the golfer will have a better feel for his shot.

The dynamic response of the club may be quantified in terms of finite element analysis and empirical modal analysis. As used herein, the term "grip end" refers to the end of the shaft to which the grip is affixed, and the term "head end" refers to the end of the shaft to which the club head is attached. Although some mathematical models of the golf club treat the grip end as a fixed boundary, the golfer's hands are coupled only viscously to the golf club. Thus the additional boundary stiffness at the grip-hand interface is negligible, and a fixed boundary condition does not apply. On the head end of the club, however, the mass of the club head relative to the shaft dominates the vibration characteristic. As a result, for finite element analysis, the club is best modeled by a beam with free-pinned boundary conditions. The pinned end corresponds to the head end while the grip end of the club represents the free end.

Mathematically, the impact of the club head against the ball is most analogous to an impulse. In response to such an input excitation, the golf club exhibits a certain modeshape, which comprises the fundamental mode and harmonics of the fundamental extending into higher frequencies. In any dynamic system, the lowest frequency mode, in this case the fundamental, has the greatest amplitude and thus exhibits the largest displacement characteristics when responding to an input excitation such as the ball-head impact. Consequently, the large-displacement, low-frequency dynamic response of the fundamental mode has the potential to provide maximum feedback to the golfer. By definition, the fundamental mode has two nodes, one near each end of the club, at which (again, by definition) the amplitude of the waveform is zero.

Finite element analysis of a pinned-free beam predicts, and empirical testing of actual golf clubs confirms, that the node of the fundamental mode near the grip end of the club (hereinafter the "grip-end node") is located at a point that is approximately 26% of the length of the club from the grip end. This location happens to fall where most golfers grip the club. As a result, the amplitude of the fundamental mode is at a minimum at the interface of the golfer and golf club, and thus the golfer's ability to feel the dynamic response of the club is muted.

The present invention provides a method and apparatus for improving the dynamic response of the golf club by moving the grip-end node of the fundamental mode further up the shaft towards the grip end and thereby increases the amplitude of the fundamental at the golfer's interface with the club. This action in turn enhances the feel of the club to the golfer.

SUMMARY

One embodiment of the invention comprises a shaft extension for improving the dynamic response of a golf club, with the upper or grip end of the club being hollow. The shaft extension includes a cylindrical member comprising a lower base sized for snug insertion in the grip end of the shaft and an upper housing of a diameter slightly larger than the inner diameter of said grip end, whereby the housing extends from the shaft when the base is inserted into the shaft. The housing has an interior chamber with an opening at the top of the housing. The shaft extension also includes an insert of predetermined weight that is inserted into and removably secured to the chamber. This may be accomplished by various means, such as by threading the body of the insert and inner wall of the chamber, or by securing the insert to the housing with a fastener such as a screw. This two part arrangement allows the club to be selectively weighted near or above the grip end of the shaft for selectively improving its dynamic response without changing the overall length of the shaft and shaft extension in combination.

Another embodiment of the invention includes complimentary cylindrical wedges for insertion into a golf club shaft. This embodiment includes an upper wedge and a lower wedge, and optionally a chamber in the upper wedge into which an insert of a desired weight may be removably secured. The friction fit accomplished by the complimentary wedges allows the combined cylindrical mass member to be fixed in a continuum of positions along longitudinal axis of the shaft. For example, the upper wedge may extend above the end of the shaft such that the chamber is wholly or partially above the end of the shaft, or the combined member may be slid further down the shaft such that the top of the upper wedge is flush with the top of the shaft or top of grip.

Another embodiment of the invention includes improving the dynamic response of a golf club by selectively adding weight to the grip end of the club until the grip-end node of the fundamental modeshape of the club moves from a first position to a second position closer to said grip end, which allows the golfer to feel through his hands a greater response of the club through increased amplitude of the fundamental at the hand-grip interface of the club.

DESCRIPTION OF DRAWINGS

These and other features, aspects, structures, advantages, and functions are shown or inherent in, and will become better understood with regard to, the following description and accompanied drawings where.

DETAILED DESCRIPTION

Figure 1:
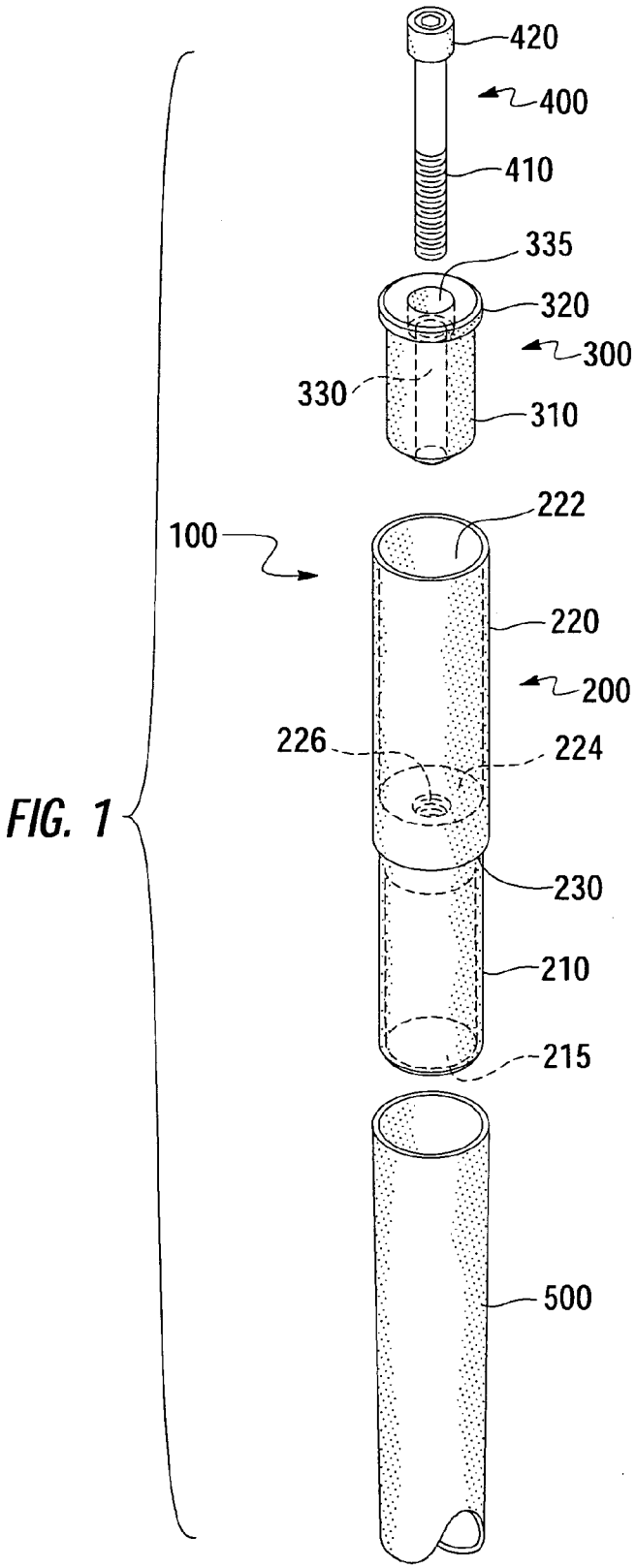
FIG. 1 is a perspective exploded view of an embodiment of the apparatus of the present invention.

As shown in FIG. 1, one embodiment of shaft extension 100 comprises an elongated cylindrical body 200 and a weighted insert 300 removably secured to the body 300. In the embodiment shown, a fastener such as retaining screw 400 performs this function. The shaft extension 100 is designed to be inserted into the grip end of a hollow golf club shaft 500. The shaft 500 may be a shaft for a putter or a full swing club, although the embodiment illustrated in FIGS. 6A-B, described below, is preferred for the latter.

Figure 2:
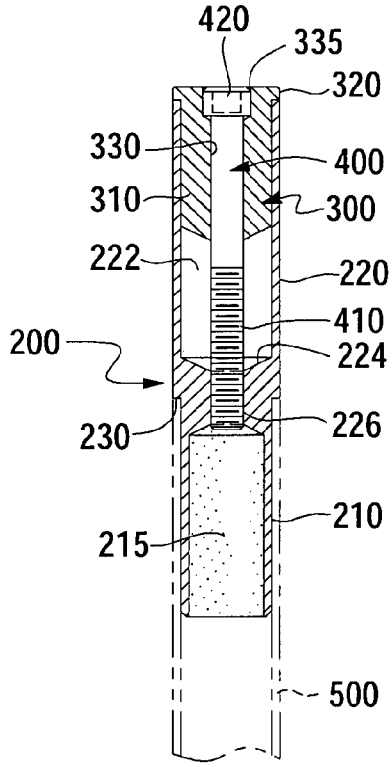
FIG. 2 is a sectional view of the embodiment of FIG. 1 assembled and installed on a golf club shaft.
Figure 3:
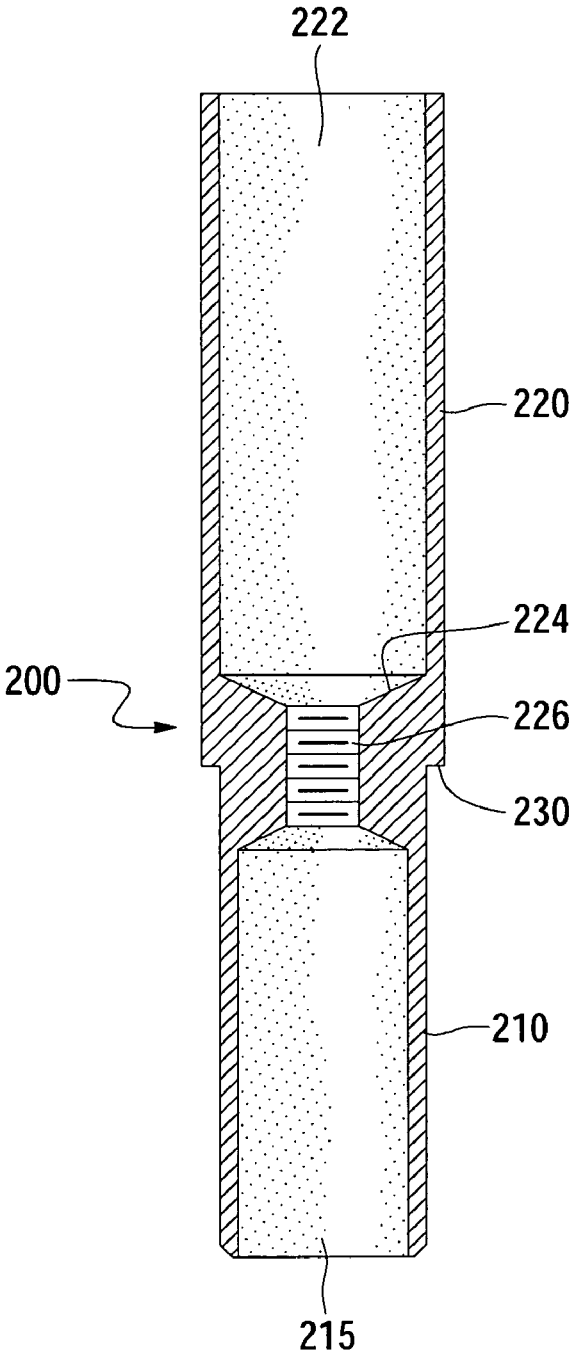
FIG. 3 is a sectional side view of the cylindrical member shown in FIG. 1.

Referring to FIGS. 1 and 2, the cylindrical member 200 comprises a lower base 210 having an outer diameter sized to allow it to be inserted into and fit snugly within the end of shaft 500, and an upper housing 220 with an outside diameter approximately the same as or slightly larger than the outside diameter of the shaft 500. Optionally, the base may have a longitudinal bore 215, such that it is hollow. The diameter of the bore 215 may be varied to adjust the overall weight of member 200. If a particularly heavy weight is desired or required, the base may be solid.

The upper housing 220 has a longitudinal chamber 222 sized to accommodate the weighted insert 300. The chamber 222 terminates in a threaded receptacle 226. In the embodiment shown, receptacle 226 is of a much reduced diameter, as compared to the chamber 222, and is sized to accept the threaded end of screw 400. Further, lower portion 224 of the chamber 222 may have a tapered shape of reducing diameter leading into the threaded receptacle 226. This shape is advantageous in that it effectively guides the screw 400 to the opening of the receptacle during assembly. Note that the taper need not extend fully to the opening of the receptacle to achieve this effect.

Figure 4:
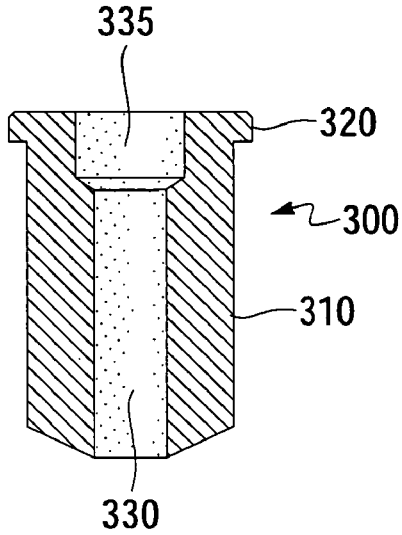
FIG. 4 is a sectional side view of the weighted insert shown in FIG. 1.

The weighted insert 300 is shown in FIGS. 1 and 4. In this embodiment, the insert 300 comprises a body 310, an upper flange 320, and a longitudinal bore 330. The body 310 is sized to fit within the housing 220 of the cylindrical member 200, and the flange 320 is of approximately the same diameter as the outside diameter of the housing 220, such that the flange acts as a stop when the body 310 is inserted into the housing 220. The longitudinal bore 330 accommodates the barrel 410 of screw 400 and includes an enlarged recess 335 to receive the screw's cap 420.

This embodiment is installed onto a golf club, without a grip installed, as follows. The base 210 of cylindrical member 200 is inserted into the end of a hollow shaft 500. A small shoulder 230 is formed at the junction of the base 210 and the housing 220, and this shoulder 230 thus acts as a stop as the member 200 is inserted into the shaft 500. Consequently, the housing 220 extends from the end of the shaft 500. Note the shaft 500 may be shortened by the length of housing 200 prior to installation to maintain the same overall club length before and after installation, or if the shaft 500 may be trimmed less than the length of housing 200 or not at all if the golfer desires a slightly longer club. A suitable adhesive or epoxy may be applied to the outer surface of the base 210 to affix it permanently within the shaft 500. Further, the outer surface of base 210 may be roughened or knurled to facilitate the fit and adhesion within the shaft. The insert 300 is inserted into the housing 220 of the cylindrical member 200, and the barrel 410 of the screw 400 is then inserted through the bore 330 in the insert 300. The screw 400 is threaded into the recess 226, fixing the insert in position. Optionally, the body 310 of insert 300 may be of a slightly reduced diameter, such that it is not in contact with the inner wall of the housing 220 (i.e., there is a small air gap between the two). Thus, the insert 300 simply drops into place with the flange 320 bearing against the upper opening of the housing 220. Further, in this case the cap 420 of screw 400 and the recess 335 of the bore 330 may be cooperatively sized such that the cap 420 is actually press fit into the recess 335 as the screw 400 is threaded into the receptacle 226 during assembly. As a result, the insert 300 then turns with the screw 400, which allows for easy removal and replacement of the insert 300.

The component parts of the shaft extension 100 may be constructed from any suitably durable and rigid material, including metals such as brass, aluminum, lead, tungsten, titanium, stainless steel, nickel and their alloys. For simplicity, when a metal is identified herein, such as tungsten, such identification refers to the metal and its alloys known in the art. It is contemplated that composite materials also could be used. The component parts may be manufactured by any conventional machining, casting, molding, or other fabrication technology. Alloys of brass and aluminum are preferred for their relatively low cost, availability, durability, and ease with which they may be worked. Utilizing inserts of brass, aluminum, and tungsten also increases the range of the weight of the inserts due the different densities of the metals.

Figure 5:
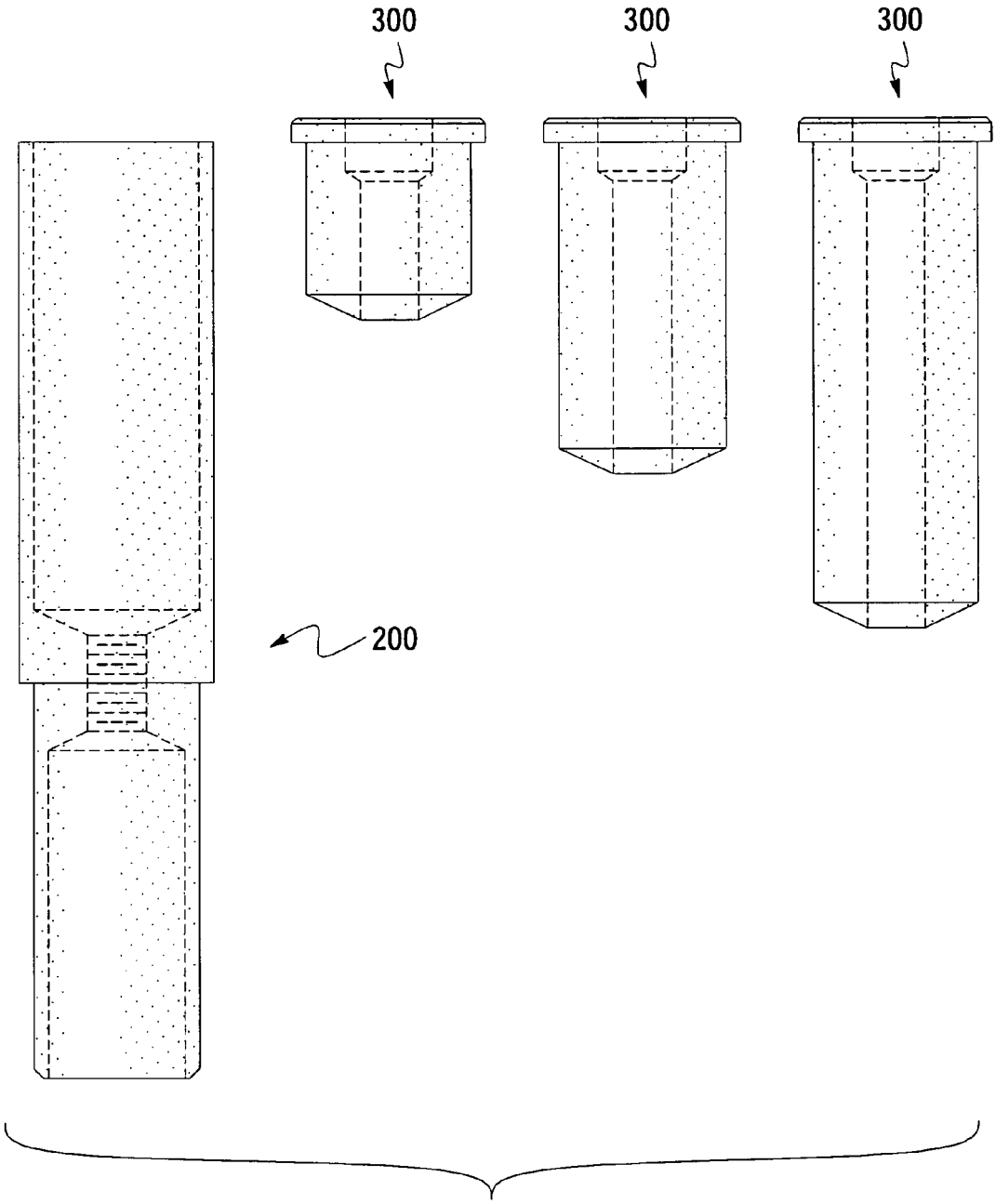
FIG. 5 is a sectional side view showing variably weighted inserts which may be used with the cylindrical member of FIG. 3.

As shown in FIG. 5, a plurality of interchangeable weighted inserts 300 of varying sizes are provided to allow selective weighting of the cylindrical member 200, which results in a shaft extension 100 of a precise and desired weight. As noted above, the inserts 300 may be constructed of materials of different densities to allow a broad range of weights to be added to the club. For example, the inserts may range from a small aluminum insert of 5 grams to a tungsten insert of 250 grams or more that occupies the entire chamber 222 of housing 220. Likewise, the cylindrical member 200 may be constructed from a relatively heavy material such as brass or a relatively light material such as aluminum as needed or desired for the particular application. Thus, the weight of the insert may be adjusted, without changing the length of the shaft extension 100 or the combination of the extension 100 and shaft 500. As described below, weights of varying mass are interchanged to achieve the desired dynamic response in accordance with the method of the present invention.

By way of example, one embodiment of the cylindrical member 200 is 3.125 inches long, of which the upper housing 220 is 1.900 inches and the lower base 210 is 1.250 inches. The outer diameter of the upper housing 220 is 0.600 inches, with the diameter of the chamber 222 being 0.516 inches. The chamber 222 is 1.790 inches long, with the tapered end 224 accounting for approximately 0.09 inches of this length. The chamber 222 may be drilled with a standard 33/64 bit with a 118 degree point. The threaded receptacle 226 is approximately 0.34 inches long, with a 10-24 thread, and is approximately 0.141 inches in diameter (9/64 drill size or equivalent for 10-24 thread). The outer diameter of the lower base 210 is 0.540 inches, with the diameter of the longitudinal bore 215 being 0.453 inches. The longitudinal bore 215 is 1.02 inches long, with the final approximate 0.09 inches being tapered. The bore 215 may be drilled using a 29/64 bit with a 118 degree point. The cylindrical member 200 made of aluminum according to these specifications weighs approximately 13 grams.

By way of example, one embodiment of the insert 300 is 1.843 inches long, with the flange 320 accounting for 0.100 inches of this length. The outside diameter of the flange is 0.600 inches. The outside diameter of the body 310 is 0.500 inches. The longitudinal bore 330 is 0.189 inches in diameter, with the enlarged recess 335 being 0.297 inches in diameter. The bore 330 may be drilled with a 4.8 mm drill size, and the recess 335 may be drilled with a 19/64 drill. The insert 300 made of brass according to these specifications weighs approximately 41 g. Additional inserts shorter in length but of the same dimensions, or made of tungsten or aluminum, also may be utilized for variable weighting. Such weights range from as little as 5 grams for a small aluminum weight to hundreds of grams. It has been found that weights above 250 grams provide only marginal benefit. A typical two-inch, 10-24 thread stainless steel socket head cap screw weighs about 9 grams.

It should be noted that the embodiment of the apparatus of the invention described above, utilizing the screw 400 in combination with the bore 330 and small threaded receptacle 226 to secure the weighted insert to the housing, is only one embodiment of the invention. Alternatively, the threaded receptacle 226 could be of the same diameter as the chamber 222 (i.e., a portion of the walls of chamber 222 would be threaded to form receptacle 226) with the lower end of the insert 300 cooperatively threaded to secure it into the same. Likewise, the upper portion of the walls of chamber 222 could be threaded, with the upper portion of the body of the insert 300 complementarily sized and threaded, with the body being of a reduced diameter or tapered below the threads to allow full insertion into the chamber 222. In this embodiment, the length of the body or angle of taper could be varied to adjust the weight of the insert.

Figure 6A:
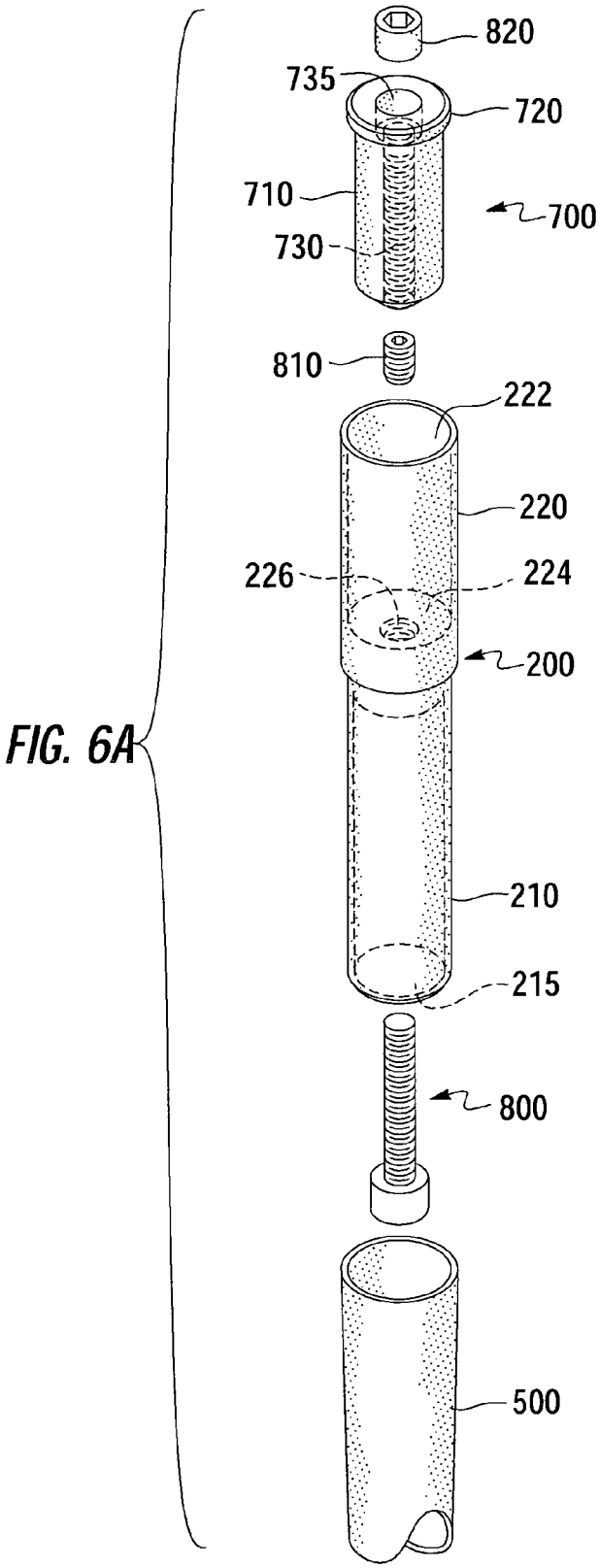
FIGS. 6A-C depict an alternative embodiment of the apparatus of the present invention.
Figure 6B:
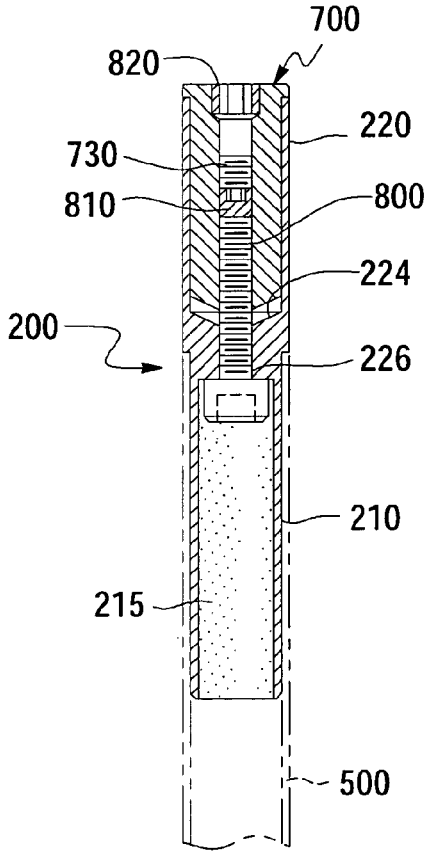
Figure 6C:
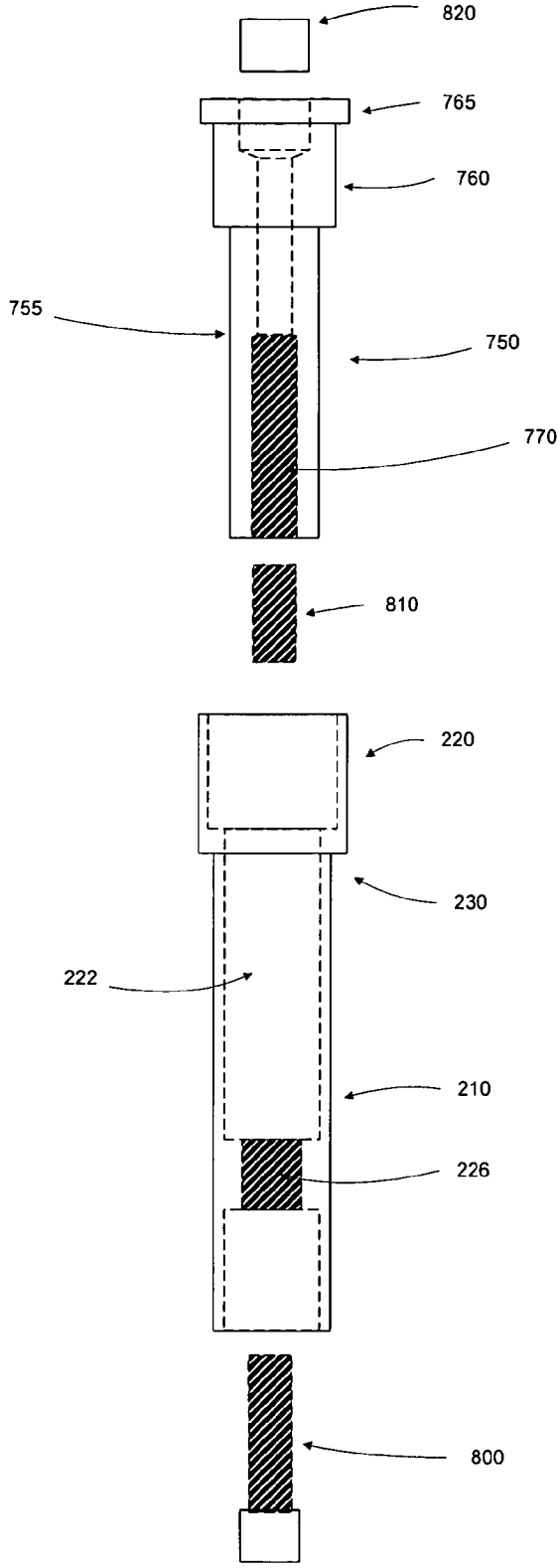

FIGS. 6A-C illustrate alternative embodiments of the invention that are particularly suited for full swing clubs such as drivers. The embodiment of FIGS. 6A-B is similar to the embodiment shown in FIG. 1, but utilizes a different securing mechanism and typically has a longer lower base 210 and shorter upper housing 220 due to the lesser mass required to improve the dynamic response of a full swing club. Further, a slightly different weighted insert 700 is utilized. The inner wall of the longitudinal bore 730 is threaded as shown. As shown in FIGS. 6A-6B, a screw 800 is inserted through the bore 215 of the cylindrical member 200 and threaded into and through the receptacle 226. A portion of the threaded end of the screw 800 protrudes into the chamber 222 of the upper housing 220. As shown, a set screw 810 is threaded from the bottom of the longitudinal bore 730 into its upper end where the threads stop. An adapter 820, which has a hollow keyed interior, is press fit into the enlarged recess 735 of the bore 730. Preferably, the body 710 of the insert 700 is of a slightly smaller diameter than the chamber 222, such that their respective surfaces are not in contact as described above. The insert 700 is then inserted into the chamber 222 where the lower end of the threaded bore 730 engages the protruding cooperatively threaded end of the screw 800, and the insert 700 is then threaded onto the screw 800 and tightened, utilizing adapter 820, until the flange 720 bears firmly against the upper end of chamber 222. The set screw 810 is accessed through the hole in the adapter 820 and tightened firmly against the end of the screw 800 to lock the assembly in place. Note that the recess 735 could be machined such that the adapter 820 is unnecessary, but the foregoing design allows for decreased manufacturing costs and the use of inserts from the primary embodiment with a threaded bore. Also, the set screw 810 is optional if a less secure attachment is desired for a particular application or golfer.

FIG. 6C is similar the embodiment of FIGS. 6A-B, but in the embodiment of FIG. 6C a portion of the chamber 222 and consequently of the weighted insert 750 are located below the terminus of the grip end of the shaft when the device is installed. Specifically, this embodiment utilizes a differently shaped weighted insert 750, which includes a lower portion of slightly reduced diameter 755, an upper portion 760 and a flange 765. The insert 750 also includes a partially threaded bore 770. The chamber 222 of the upper housing 220 is shaped to receive the insert 750. The shoulder 230 of the upper housing acts as a stop against the grip end of the shaft. This embodiment otherwise is installed in the shaft as described above with respect to FIGS. 6A-B.

The partially threaded bore 730 in FIGS. 6A-B (or 770 in FIG. 6C) facilitates removal of the weighted insert from the screw 800. An elongated allen key (or other tool that fits set screw 810) is inserted through the hole in adapter 820 to engage set screw 810. Set screw 810 is unscrewed up the bore 730 (or 770) until it stops against the unthreaded portion of the bore. Then, because the set screw will no longer turn independently, the entire weighted insert 700 (or 750) turns as the allen key is turned, thus unscrewing the insert from the screw 800 and allowing easy removal or replacement of the insert.

Figure 9:
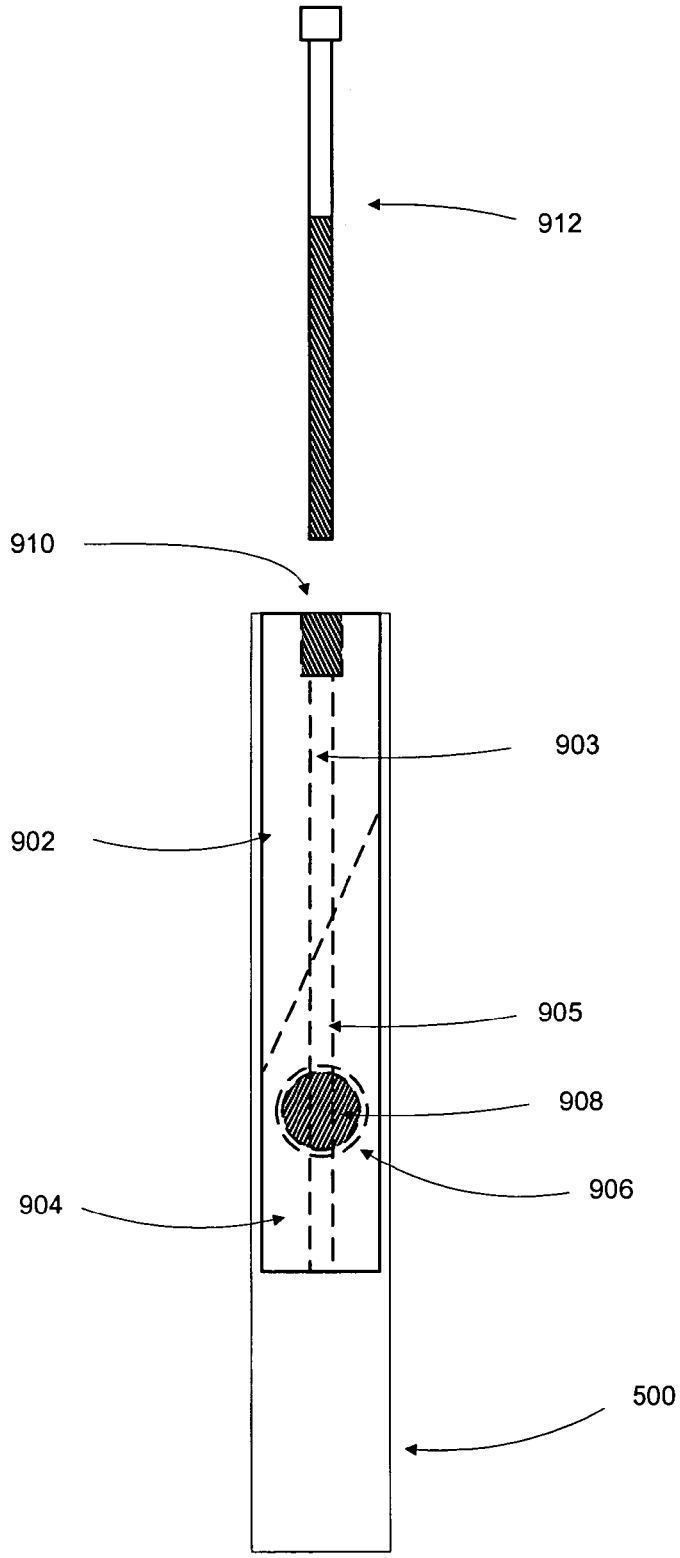
FIG. 9 shows a side view of the complementary wedge embodiment of the present invention.
Figure 10A:
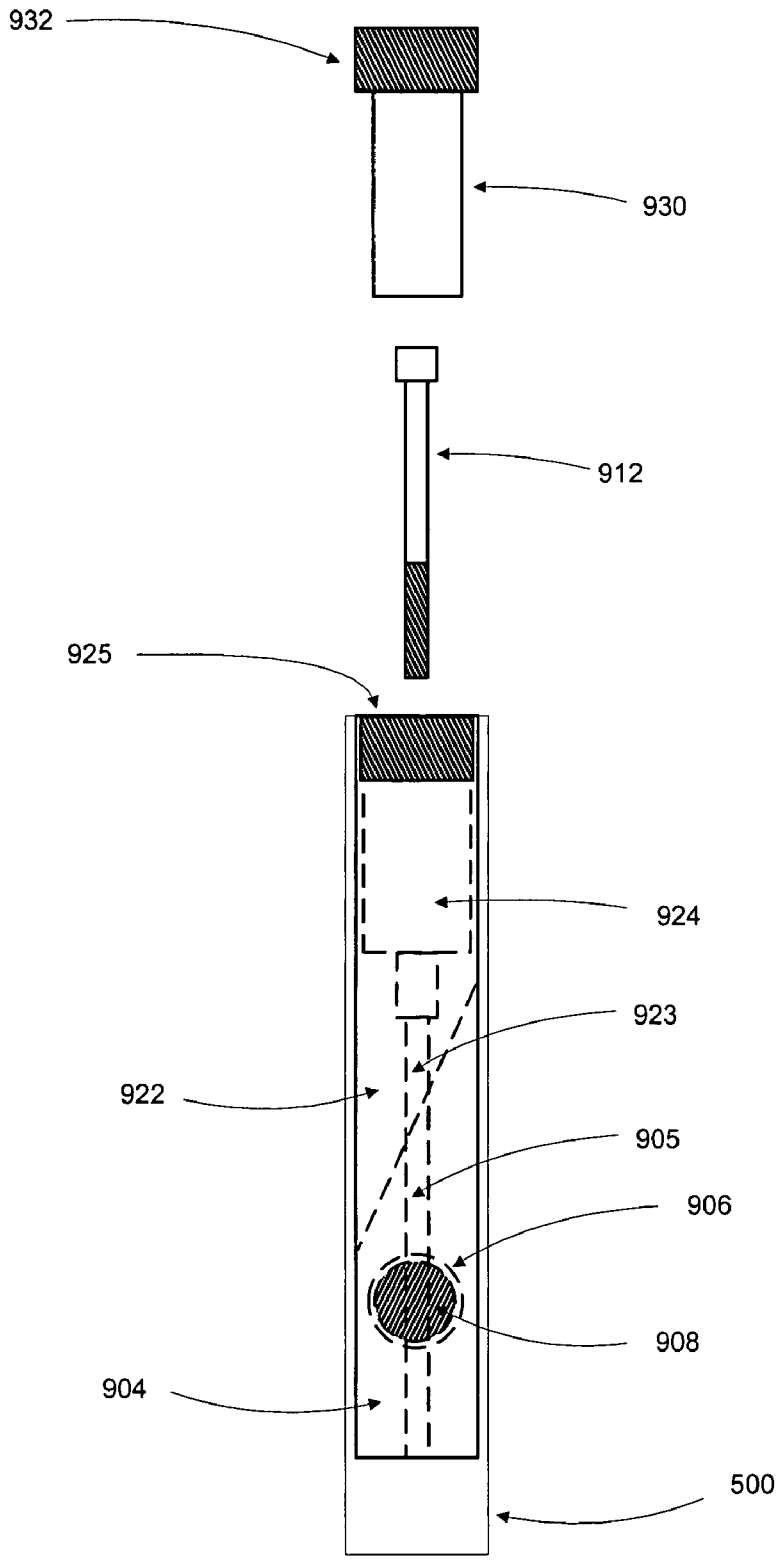
FIGS. 10A-C show an exploded side views of the complementary wedge embodiment of the present invention, with an upper chamber to accept a weighted insert.
Figure 10B:
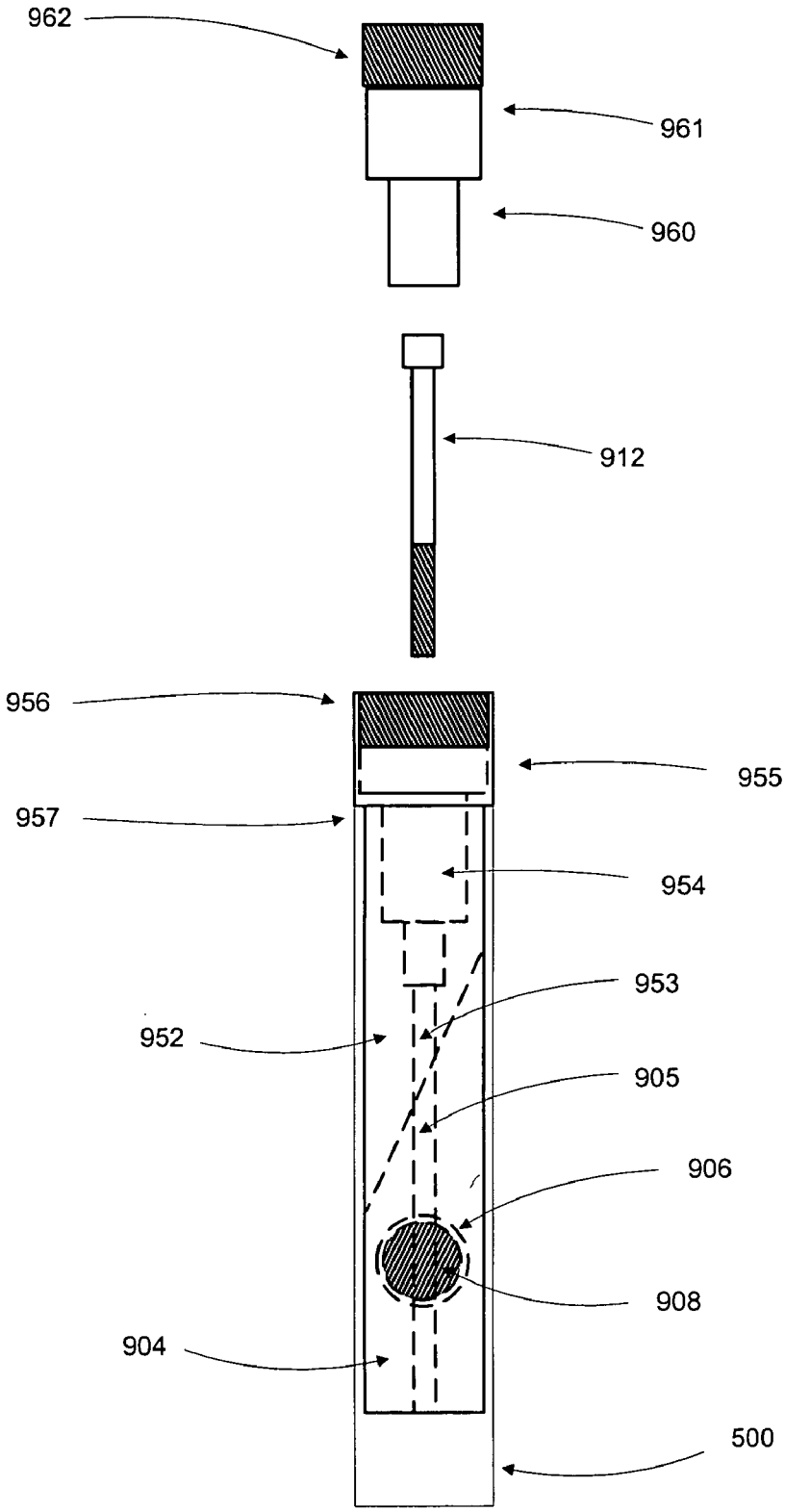
Figure 10C:
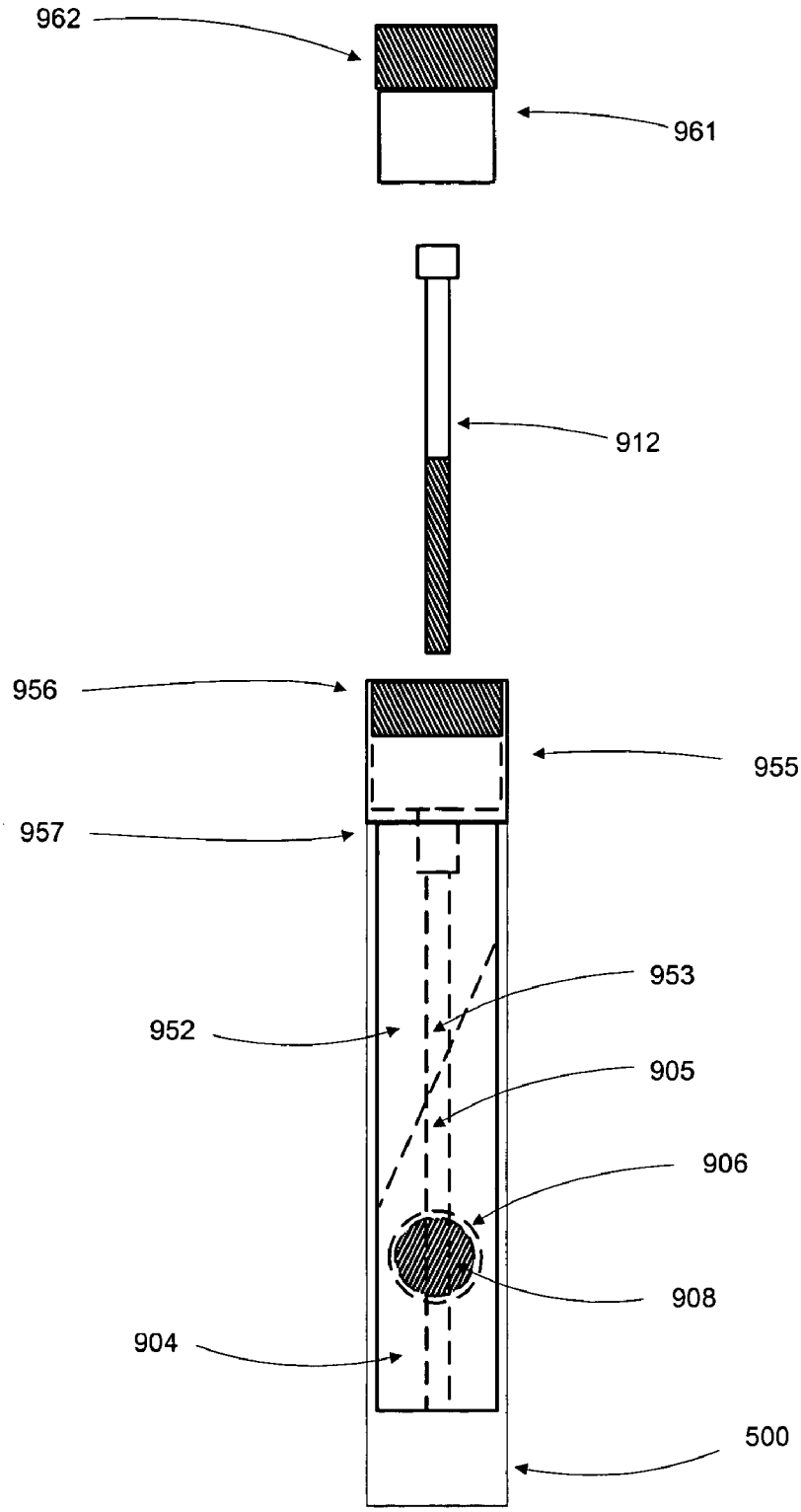

Another embodiment of the present invention is shown in FIG. 9, and is referred to as the complementary cylindrical wedge embodiment, with variants of this embodiment shown in FIGS. 10A-C. As shown in FIG. 9, the basic complementary cylindrical wedge embodiment comprises an upper wedge 902 and a lower wedge 904, each with an axial, longitudinal bore 903 and 905, respectively. The external diameter of the upper and lower wedges is slightly less than the internal diameter of the shaft 500, and as explained below, the friction fit mechanism of this embodiment allows one pair of wedges to accommodate a variety of shaft diameters. The lower wedge 904 includes a diametrically transverse, cylindrically shaped cavity 906 into which is inserted a threaded receptacle 908. The receptacle 908 is of slightly smaller diameter than the cavity 906 such that it may rotate within the cavity. Accordingly, the receptacle 908 may be any shape that allows such movement, such a cylindrical or spherical. The receptacle 908 has a female threaded diametrical bore. Upper wedge 902 includes a recess 910, which may be female threaded to facilitate removal of the upper wedge 902 with a male threaded tool. A screw 912 serves as a fastener. It is of smaller diameter than the bores 903 and 905, and sized and threaded to screw into the bore of receptacle 908. The sizes and materials of upper and lower cylindrical wedges 902 and 904 may be varied to adjust the weight of this embodiment.

To install the wedge embodiment into a golf club shaft, the receptacle 908 is inserted into the cavity 906, with the receptacle's diametrical bore aligned with the bore 905 of the lower wedge. The upper and lower wedges are slid a desired amount into the shaft 500, at least so far as to insert the upper edge of the junction of the two wedges within the shaft. Typically, the wedges are inserted such that the top of the upper wedge is flush with the grip end of the shaft 500, or if a grip is installed on the club, with the top end of the grip itself. It should be noted here that this embodiment can be installed into a shaft with a grip installed by removing the top cap of the grip with a cutting tool. Because the top of grips are of varying depths, the longitudinal adjustability of this embodiment allows the top of the upper wedge to be aligned flush with the top of the grip on any model grip.

The screw 912 is then inserted through the bore 903 in the upper wedge, into the bore 905 of the lower wedge, and threaded into the receptacle 908. As the screw 912 is tightened into the receptacle the upper cylindrical wedge 902 is drawn onto the lower cylindrical wedge 904 until a friction fit with the interior of the shaft 500 is created. Because the bores 903 and 905 are of a larger diameter than the screw 912, and the receptacle 908 is free to rotate within the cavity 906, the upper and lower wedges are offset slightly from one another, and bear against the interior wall of the shaft, as the screw is tightened in place. The amount of offset is directly related to the difference in diameters between the screw 912 and the bores 903 and 905. The greater the difference, the greater offset may be achieved, and therefore the greater range of shaft diameters that can be accommodated with the friction fit.

FIGS. 10A-C show a variant on the cylindrical wedge embodiment. The embodiment shown in FIG. 10A uses the same lower wedge 904 shown in FIG. 9 and includes an upper wedge 922 with a chamber 924 for receiving a weighted insert 930. The insert 930 has a male threaded section 932 of larger diameter. The upper portion 925 of the chamber 924 is female threaded to receive and secure the threaded section 932 of insert 930. The chamber 924 is shown entirely within the shaft 500; however, as with the embodiment shown in FIG. 9, the wedges may fixed in a continuum of positions within the shaft and with the upper wedge extending from the shaft as long as its the upper edge of the junction of the two wedges is contained within the shaft.

FIGS. 10B and 10C illustrate embodiments in which the chamber is partially (FIG. 10B) or wholly (FIG. 10C) above the shaft 500. In each of these embodiments, the portion 955 of the chamber extending above the shaft has approximately the same outside diameter and the outside diameter of the shaft 500, thus forming a slight interface 957 between the external chamber and the remainder of the upper cylindrical wedge that fits within the shaft 500. The weighted inserts in each of FIGS. 10B and 10C have a threaded section 962 that screws into a complementary threaded section 956 in the chamber in the upper wedge. Inserts of varying weights, as discussed herein, may be substituted to achieve the desired feel of the club.

Rather than using a threaded insert mating into a threaded chamber, the weighted inserts could include an axial longitudinal bore 330 as shown in FIG. 4, in which case the bore 330 would be similarly sized to the axial, longitudinal bores in the upper and lower wedges. A single screw would extend through the bores and into the receptacle 908 holding the mechanism together.

Figure 11:
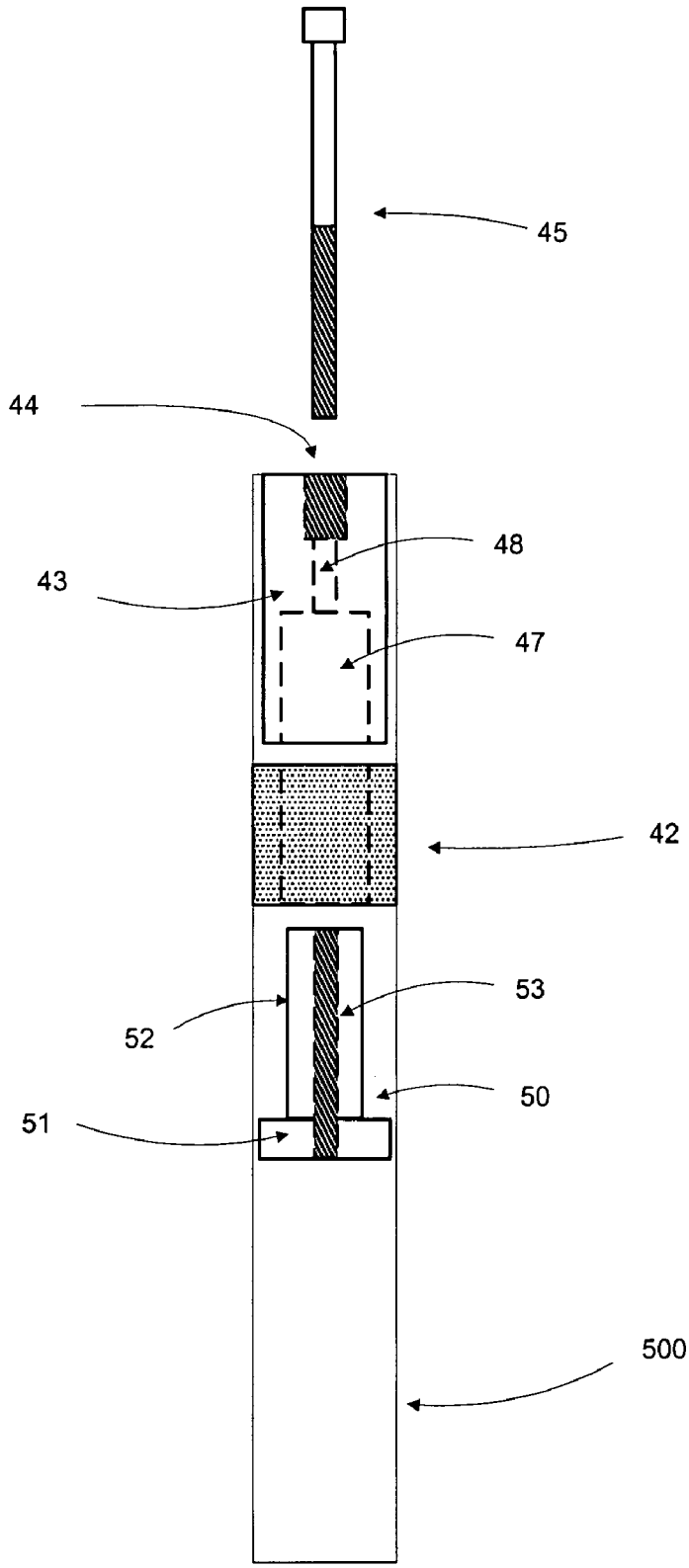
FIG. 11 shows yet another embodiment of the apparatus of the present invention, which utilizes compression of a polymer ring to effect a friction fit of the cylindrical member within the golf club shaft.

Yet another embodiment of the present invention is shown in FIG. 11, also using a friction fit to secure a cylindrical mass into the shaft. As shown, this embodiment includes a cylindrical member 43 with a lower chamber 47; a weighted insert 50 with a flange 51 and body 52, with an axial threaded bore 53 therethrough; a polymer ring 42 through which the body 52 of the insert 50 may be inserted; and a screw 45. The screw 45 is inserted trough the cylindrical member 43, the polymer ring 42, and into the weighted insert 50, where it engages with the threaded bore 53. As the screw is tightened, it draws the weighted insert into the chamber 47 of the cylindrical member and the flange 51 bears down on the polymer ring 42. This causes the polymer ring to expand diametrically and creates a friction fit between the shaft 500 and the assembly just described.

The method of the present invention modulates the position of the grip-end nodal location of the fundamental modeshape of a golf club. The fundamental mode nodal location is a result of the combination of five factors: club length, the mass of the club head, the mass of the shaft extension, the mass of the grip, and the mass of the shaft (which includes shaft shape and taper, shaft moment of inertia (I), and shaft stiffness (EI)).

The length of a given golf club affects the distance from the location of the grip-end node of the fundamental mode to the end of the club. This distance is directly proportional to the length of the club. Thus, standard analytical methods used in dimensionless analyses are applied to simplify comparing clubs of differing lengths. As a result, all length data herein is presented as a percentage of total club length. For example, if a node is found to be six inches from the grip end of a 36-inch long shaft, the distance will be expressed 16.7% of shaft length ($100*\frac{6}{36}=16.7\%$). The preferred embodiment of the apparatus of the present invention allows variation of the weight of the club without variation in its length, thus minimizing the effect of one variable on the dynamic response of the club.

As noted above, the mass of the club head highly influences the location of the head-end node of the fundamental mode, and the free-pinned boundary condition is utilized for analytical analysis of the golf club because the mass of the head drives the fundamental mode head-end node nearly to the end of the entire club. Deviations in the mass of the head above approximately 225 grams produce only negligible changes in the positions of the fundamental mode grip-end and head-end node locations.

Weight appropriately added to the grip end of the club perturbs the location of the grip-end node and increases the dynamic response of the club to the golfer. The empirically measured effect of increasing weights added to the grip end of one golf club on the location of the grip-end node of the fundamental mode was determined for a Ping Answer II putter without a grip installed.

The location of the grip-end node of the fundamental mode was found to be 26.4% of the length of the club from the grip end of the club with no mass added. This value is consistent with the analytically predicted solution for pinned-free beams of prismatic shape. A mass of 200 grams added to the grip end of the club moved the grip-end node to a point approximately 8% of the length of the club away from the grip end. This data confirms the effectiveness of the method of the present invention.

Figure 7A:
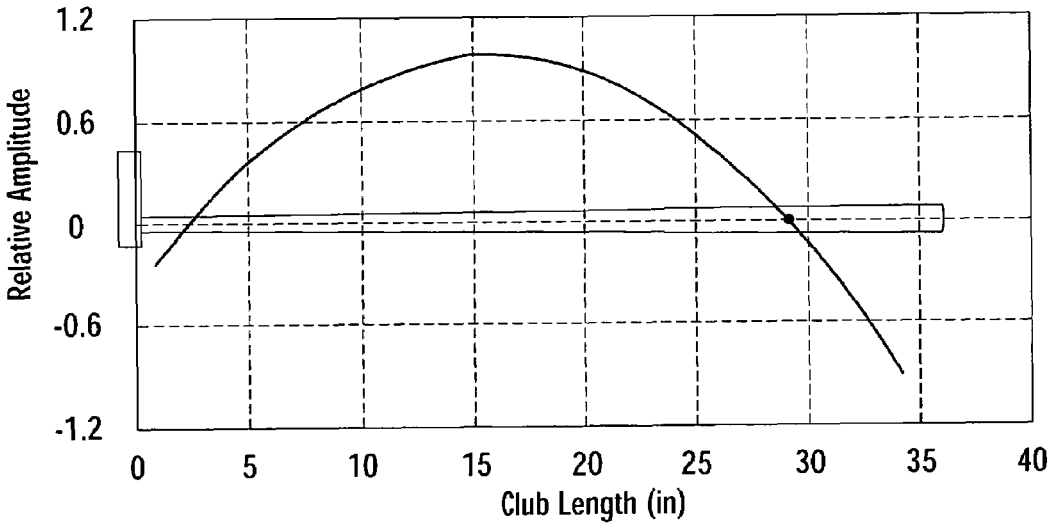
FIGS. 7A-B are graphical illustrations of the perturbation of the location of the grip-end node of fundamental mode-shape effected by practicing the method of the present invention.
Figure 7B:
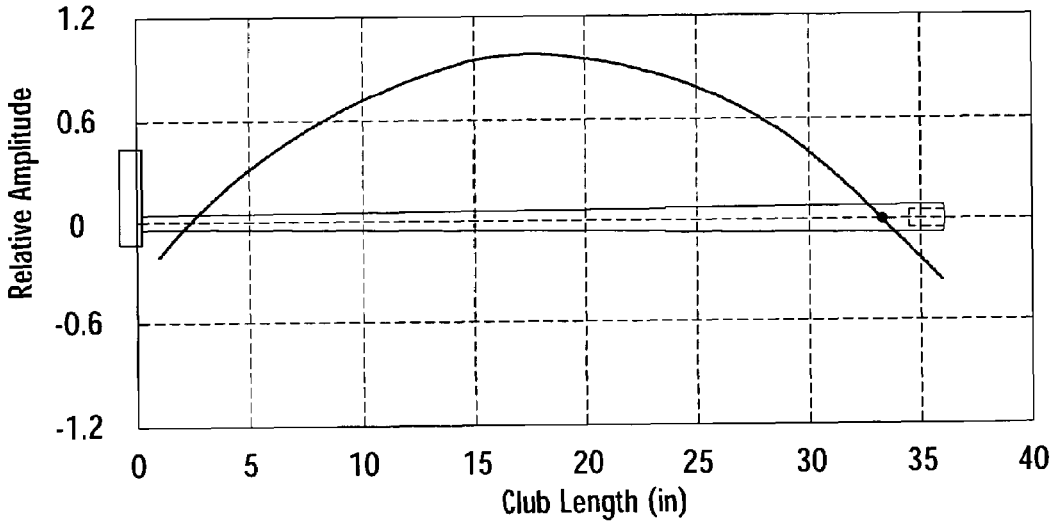

FIGS. 7A and 7B illustrate graphically examples of the fundamental modes of a golf club before (FIG. 7A) and after (FIG. 7B) the location of the grip-end node has been adjusted in accordance with the present invention. The grip-end node is represented by the enlarged dot in the grip area of the club. Further, based on field testing performed to date, nearly all golfers perceive an improvement in club performance when the grip-end node of the fundamental mode is moved upwards closer to the grip end of the shaft. Some golfers prefer a maximum dynamic response. The maximum dynamic response is the response where the amplitude of the fundamental is at its greatest in the region of the grip grasped by the player. This is achieved by selectively adding weight until the dynamic response is greatest. Others may prefer more subtle changes in the response. The preferred amount of change can be fine tuned to suit such individual preferences, as described below.

The mass of a grip installed on a club influences the magnitude of movement of the fundamental mode grip-end node position that results from the addition of the shaft extension mass. The additional mass of the extension produces less nodal deviation with the grip installed because the grip mass, shaft mass, and extension mass function together to define the position of the node. Simply stated, the extension mass is less dominant when the grip is installed.

As with the added mass of the grip, a more massive shaft reduces the effect of the shaft extension on the position of the grip-end node. It is noteworthy that that standard golf club shafts are not prismatic as they taper from the grip end to the head end. This taper does affect the head-end node location but it introduces very little perturbation to the grip-end node location because the taper is generally very small on the grip end of the club. Nevertheless, to provide a brief explanation, the effect of taper on golf club dynamics results from a change in shaft weight and stiffness. As the shaft tapers, its area moment of inertia (I), a function proportional to the shaft diameter to the fourth power (D4), reduces while the shaft's respective area (A) reduces in relation to the square of the diameter (D2). Bending stiffness (EI) is determined by the product of modulus of elasticity (E) and the area moment of inertia (I). Shaft weight is determined by product of the material density (ρ), cross sectional area, and the respective shaft length=ρAL. Thus the stiffness of the shaft reduces faster than the weight.

Several design parameters thus affect the exact position of the grip-end node of the fundamental node in response to the added weight. Thus the anticipated perturbation in node location can be bounded to include reasonable combinations of the aforementioned design parameters. Fundamental mode grip-end node locations were recorded from a large database of clubs as varying weights were added to the grip-end of the club.

The results of this analysis clearly indicate that the change in node position is nonlinearly related to the amount of weight added to the club. A fourth-order polynomial curve fit characterizes these results accurately. According to the data gathered, the addition of weight to the grip end of the club using the apparatus of the present invention produced a minimum fundamental mode grip-end node perturbation described by the following lower bound equation:

$$(\%\ \text{Length})=1.45\times10^{-11}m^4-1.12\times10^{-08}m^3+2.92\times10^{-06}m^2-4.22\times10^{-04}m+8.73\times10^{-02}$$

where m equals the mass added to the end of the club. According to the data gathered, the maximum node perturbation is described by the following upper bound equation:

$$(\%\ \text{Length})=2.35\times10^{-10}m^4-1.52\times10^{-07}m^3+3.67\times10^{-05}m^2-4.11\times10^{-03}m+3.28\times10^{-01}$$

For example, according to the foregoing equations a 100-gram addition to the grip end of a club will displace the grip-end node a minimum of 6.4% of the club length and a maximum of 15.5% of the length, depending on the mass of the shaft, mass of the club head, and mass of the grip installed on the club. For a 34-inch long club, this range correlates to between 2.19 and 5.27 inches from the grip end of the club. It should be emphasized that the foregoing equations describe upper and lower bounds empirically determined by testing a variety of clubs.

For any given club, the mass of the club head, grip, and shaft are fixed and thus the weight added to the grip end can be parametrically varied to displace the grip-end node a desired distance from the starting point. This may be accomplished by modal analysis of the golf club in a fixture as weight is added, or subjectively by an individual golfer according to feel.

Modal analysis of the golf club involves exciting the club assembly with an electro-dynamic shaker. The golf club is suspended with elastic cords while the shaker is driven with a sinusoidal input. The frequency of the input waveform is adjusted until a maximum displacement or amplitude response is observed in the golf club. This frequency represents the golf club's fundamental resonant frequency. With the club driven by the shaker at its fundamental resonant frequency, and with an antinode displacement amplitude of approximately 0.5 inch, the grip end node can be visually identified easily with an accuracy of less than 0.05 inch. Weight inserts can then be added to the grip end of the club and a relationship between the node location and the amount of added weight can be readily determined. This method can be employed with or without the grip installed on the club. This approach is suitable for determining and adjusting the location of the grip-end node in a club to be manufactured, or other relatively large-volume setting. Assuming the end of the club is weighted using the apparatus of the present invention, the feel of the club could be further fine tuned by the individual golfer by adjusting the weight of the insert installed on the shaft extension.

In a non-balanced golf club, the location of the grip end node of the fundamental mode is typically under the lower hand. Thus, the golfer will not perceive vibrational motion from the amplitude associated with the fundamental mode in his lower hand since it is located over the node. In fact, the area around the node has such a low amplitude that it is generally below the threshold of human perception. With the present invention, it is possible to move the node to a location between the hands. With the node in this location, the largest contact area of both hands interface the gripping region where the amplitude associated with the fundamental mode's vibration is larger than the threshold of human perception. With the node located between the hands, the amplitude of the dynamic response within the gripping region is maximized.

Figure 8A:
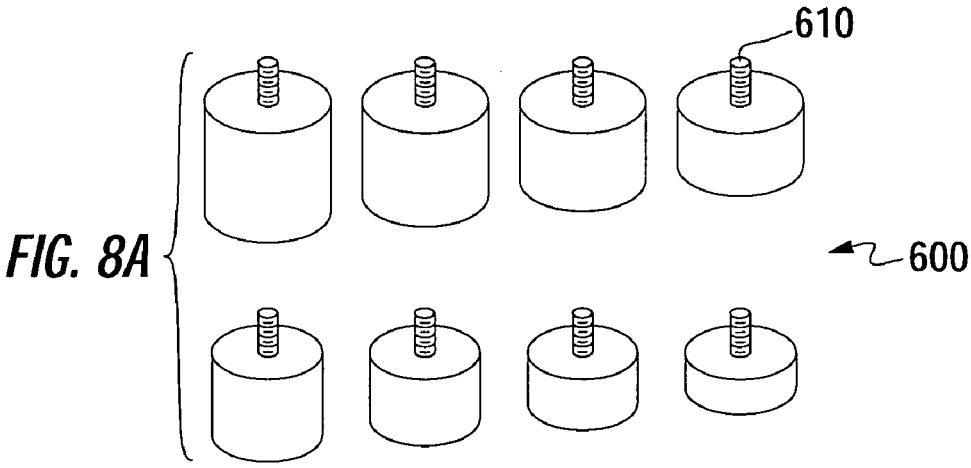
FIGS. 8A-B show test weights which may be used in practicing the method of the present invention.
Figure 8B:
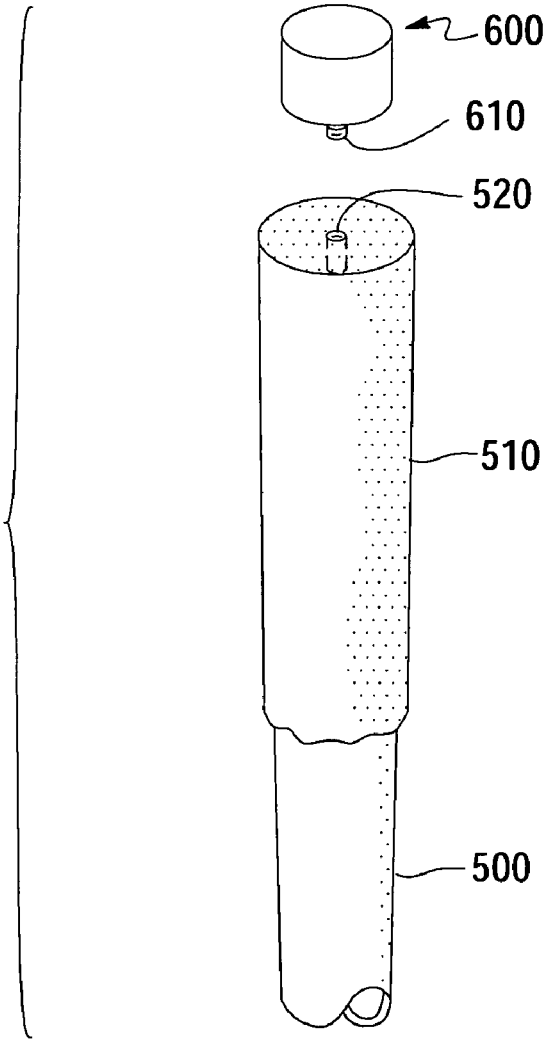

The method can be practiced for retrofitting individual clubs as well. Referring to FIGS. 8A-8B, with the grip 510 installed on the shaft 500 of a club to be fitted, a small pilot hole 520 is made in the upper end of the grip 510. One of a plurality of variably weighted test weights 600, each with a small pin 610 adapted to mate with the pilot hole, is installed on the end of the club. The mass of the sample weight is varied parametrically until the golfer perceives a desired improvement in the dynamic response of the club. In this manner, the initial mass magnitude of the extension 100 is determined so that it can be correctly sized to provide the golfer the desired benefit. For example, some golfers may prefer a much lighter mass than others, which may call for an aluminum cylindrical member 200 with a large diameter longitudinal bore 215 in the base 200, while others may prefer a heavier extension, which may call for a brass cylindrical member 200 with a smaller diameter bore 215. After the cylindrical member 200 has been installed on the shaft, the mass of the inserts 300 can be varied to fine tune the grip-end node of the fundamental. Further, the golfer can later exchange inserts to relocate the node in accordance with changes in skill, preference, or course conditions.

The apparatus of the present invention is advantageous in practicing the method. The further towards the grip-end of the club weight is added, the greater its effect upon the location of the grip-end node. With the apparatus illustrated in FIGS. 1 to 5, the housing 220 and insert 300 comprise the vast majority of the mass of the extension. They are located above the shaft and at the end of the club, thus maximizing their effect on the nodal location. Further, the apparatus of the present invention allows the mass of the weighted inserts to be interchanged without varying the length of the club, which enables more precise tuning of the nodal location by varying the weight of the insert only.

Although the present invention has been described and shown in considerable detail with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

I claim:

1. A device for adding weight to a hollow shaft of a golf club, said device comprising:

a screw comprising an elongate barrel, at least part of which is threaded, and a cap larger in diameter than said barrel;

an upper wedge member substantially shaped as a cylinder with its lower face diagonal to its axis, and comprising a first axial bore larger than the barrel of said screw, and wherein the upper end of said first bore is enlarged to receive the cap of said screw and is threaded to facilitate removal of said device;

a lower wedge member substantially shaped as a cylinder with its upper face diagonal to its axis, and comprising a second axial bore larger than the barrel of said screw and a cylindrically shaped cavity transverse to and intersecting said axial bore; and a receptacle within said cavity, sized and shaped to rotate therein, said receptacle having a bore threaded to receive said screw;

wherein the diagonal faces of said wedge members are complementary to one another and abut one another, substantially forming a cylinder slightly less in diameter than the internal diameter of said shaft, with the barrel of said screw extending through said axial bores in said wedge members and threading into the bore of said receptacle, with its cap seated into the enlarged portion of said first axial bore.

2. The device of claim 1, further comprising a substantially cylindrical weighted insert having an outer wall that is at least partially threaded and wherein said upper wedge member further comprises an upper cylindrical section with a diameter approximately equal to the outside diameter of said hollow shaft, said upper cylindrical section having a chamber therein sized and cooperatively threaded to receive said insert.

3. The device of claim 1, further comprising a substantially cylindrical weighted insert having an upper section and a lower section, the upper section being of larger diameter than the lower section, and the upper section having an outer wall that is at least partially threaded and wherein said upper wedge member further comprises an upper cylindrical section with a diameter approximately equal to the outside diameter of said hollow shaft and a chamber having an upper section and a lower section, the upper chamber section located within said upper cylindrical section of said wedge member and sized and cooperatively threaded to receive said upper insert section, the lower chamber section sized to receive the lower section of said insert.

4. The device of claim 1, further comprising a substantially cylindrical weighted insert having an outer wall that is at least partially threaded and wherein said upper wedge member further comprises an upper cylindrical section with a diameter approximately equal to the outside diameter of said hollow shaft and a chamber sized and cooperatively threaded to receive said insert.

5. The device of claim 4, wherein said the depth of said chamber exceeds the length of said upper cylindrical section.

6. A device for adding weight to a hollow shaft of a golf club, said device comprising:

a screw comprising an elongate barrel, at least part of which is threaded, and a cap larger in diameter than said barrel;

a substantially cylindrical weighted insert having an outer wall that is at least partially threaded;

an upper wedge member substantially shaped as a cylinder with its lower face diagonal to its axis, and comprising a chamber sized and cooperatively threaded to receive said insert and a first axial bore larger than the barrel of said screw, and wherein the upper end of said first bore is enlarged to receive the cap of said screw;

a lower wedge member substantially shaped as a cylinder with its upper face diagonal to its axis, and comprising a second axial bore larger than the barrel of said screw and a cylindrically shaped cavity transverse to and intersecting said axial bore; and a receptacle within said cavity, sized and shaped to rotate therein, said receptacle having a bore threaded to receive said screw;

wherein the diagonal faces of said wedge members are complementary to one another and abut one another, substantially forming a cylinder slightly less in diameter than the internal diameter of said shaft, with the barrel of said screw extending through said axial bores in said wedge members and threading into the bore of said receptacle, with its cap seated into the enlarged portion of said first axial bore.

7. A device for adding weight to a hollow shaft of a golf club, said device comprising:

a screw comprising an elongate barrel, at least part of which is threaded, and a cap larger in diameter than said barrel;

an upper wedge member substantially shaped as a cylinder with its lower face diagonal to its axis, and comprising a first axial bore larger than the barrel of said screw, and wherein the upper end of said first bore is enlarged to receive the cap of said screw;

a lower wedge member substantially shaped as a cylinder with its upper face diagonal to its axis, and comprising a second axial bore larger than the barrel of said screw and a cylindrically shaped cavity transverse to and intersecting said axial bore; and a spherical receptacle within said cavity, sized and shaped to rotate therein, said receptacle having a bore threaded to receive said screw;

wherein the diagonal faces of said wedge members are complementary to one another and abut one another, substantially forming a cylinder slightly less in diameter than the internal diameter of said shaft, with the barrel of said screw extending through said axial bores in said wedge members and threading into the bore of said receptacle, with its cap seated into the enlarged portion of said first axial bore.

* * * * *